United States Patent [19]

Nagy

[11] 4,058,798

[45] Nov. 15, 1977

[54] LONGITUDINALLY EXTENDED PRINTING METHOD FOR COMPUTERS

[76] Inventor: Robert Andrew Nagy, 7786 Woodward Ave., Woodridge, Ill. 60515

[21] Appl. No.: 270,952

[22] Filed: July 12, 1972

Related U.S. Application Data

[63] Continuation-in-part of Ser. No. 23,630, March 30, 1970, abandoned.

[51] Int. Cl.[2] ..... G06F 3/12; G06K 3/00

[52] U.S. Cl. ..... 364/900; 101/93.14; 101/93.18

[58] Field of Search ..... 340/172.5; 197/1.10, 197/16, 49; 101/99, 111, 93.14, 93.18; 348/172.5

[56] References Cited

U.S. PATENT DOCUMENTS

| | | | |
|---|---|---|---|
| 144,450 | 11/1873 | Galloway | 197/10 |
| 420,843 | 2/1890 | Brandis | 197/46 |
| 544,345 | 8/1895 | Buckingham | 178/27 |
| 725,855 | 4/1903 | Loyd | 197/23 |
| 765,532 | 7/1904 | White | 197/1 R |
| 867,868 | 10/1907 | Beals | 197/12 |
| 1,339,369 | 5/1920 | Roble | 197/10 |
| 1,746,516 | 2/1930 | Boyer | 101/99 |
| 2,879,876 | 3/1959 | Palmer et al. | 197/16 |
| 3,159,101 | 12/1964 | Dziekan | 101/111 |
| 3,276,357 | 10/1966 | McKay | 101/111 |
| 3,338,160 | 8/1967 | Heil | 101/99 |
| 3,629,850 | 12/1971 | Clark et al. | 340/172.5 |
| 3,987,884 | 10/1976 | Buxton | 197/49 |

*Primary Examiner*—Mark E. Nusbaum
*Attorney, Agent, or Firm*—Hill, Gross, Simpson, Van Santen, Steadman, Chiara & Simpson

[57] ABSTRACT

Longitudinally extended printing of all types of computer output for reading in the direction in which the paper was caused to flow during printing is provided for instead of the conventional printing for reading across such direction. Existing hardware is utilized, with the imprinting characters having their reading axes disposed transversely to the axis of paper flow. Imprinting of the advancing print-out form is by means of a succession of transverse rows of the transversely orientated characters, and in each imprinted row there is added a respective character to each of a plurality of longitudinally extended lines of data to be read at completion of the print out in the direction of paper advance during printing and across the rows of imprinted characters.

3 Claims, 7 Drawing Figures

YEAR TO DATE GROSS SALARIES REPORT PAGE 200

| PLOYEE'S NAME | EMPLOYEE'S ADDRESS | EMPLOYEE'S WEEKLY SALARY | QUARTER TO DATE EARNINGS | YEAR TO DATE EARNINGS |
|---|---|---|---|---|
| AGY | 7786 WOODWARD WOODRIDGE ILLINOIS | 250.00 | 2,000.00 | 4,000.00 |
| | 627 MAYFIELD GO ILLINOIS | 200.00 | 2,000.00 | 4,000.00 |
| | | 100.00 | 1,000.00 | 2,000.00 |
| | | 50.00 | 500.00 | 1,500.00 |
| | | | 2,700.00 | 4,800.00 |
| | | | | 000.00 |

LONGITUDINALLY EXTENDED PRINTING METHOD FOR COMPUTERS

This application is a continuation-in-part of my copending application Ser. No. 23,630 filed Mar. 30, 1970, now abandoned.

This invention relates to the general field of data processing, and is more particularly concerned with a new and improved longitudinally extending printing method for computers.

Advancements in the capacity and efficiency of computer hardware have progressed very rapidly and have, in effect, outrun to a significant extent the ability of the users to take advantage of the physical advances that have been made. Advantage can be taken of the developing sophistication in computer hardware only if the output volume can be increased. Up to the present a serious limitation upon increased output volume has resided in the lateral constraint imposed upon the report designer due to the necessarily relatively limited number of print positions which may practically be provided across the page. Typically 144 print positions may be available, although this number may be slightly more or less, depending upon the size and particular manufacturer's design of the printer hardware. In any event, sheet width is bound by practical limits that may be handled in the flow pattern of any particular machine. Yet, if it were possible to increase paper width and printing ability indefinitely, effective operating time in the use of any given machine could be greatly increased with corresponding economic advantages. In addition, greater amount of information could be applied to the paper volume employed as compared to the limitations on paper use imposed up to the present where it has been necessary to program the machines with carriage control means such as tape to notify the machine when to skip a specific number of vertical spaces on the print out form paper to enable the user to compile a report in successive leaf form.

According to the present invention the foregoing and other disadvantages, shortcomings, defficiencies and problems are overcome by providing a new and improved method of and means for longitudinal printing of all types of computer output as distinguished from the prior printing of all computer output in a manner to be read laterally of the form as printed.

An important object of the present invention is to provide a new and improved method of printing of computer output.

Another object of the invention is to provide a new and improved method of printing of computer output in a continuous uninterrupted flow of print-receiving paper sheet.

A further object of the invention is to provide a new and improved method of computer output printing effective longitudinally with the paper flow axis while enabling use of the full capacity across the width of the paper.

Still another object of the invention is to enable more efficient use of computer hardware.

Yet another object of the invention is to provide for the more efficient use of paper in computer printing and thereby significantly contributing to cost reduction through adoption of the present invention.

Other objects, features and advantages of the invention will be readily apparent from the following description of certain preferred embodiments thereof, taken in conjunction with the accompanying drawings, although variations and modifications may be effected without departing from the spirit and scope of the novel concepts embodied in the disclosure, and in which.

According to the present invention, longitudinal readability of all types of computer output is provided for, instead of the conventional lateral readability utilizing existing hardware, but with the imprinting type characters having their axes oriented transversely, i.e., transversely to the axis of continuous form paper flow in the printer. There is no limit except user preference as to the length of the print-out form. Limit on width of form is controlled only by the number of longitudinal lines which the computer machine printer is capable of printing in laterally spaced relation across the paper width.

For ease of expression and understanding, the term "transverse" is used herein to designate the direction across the path or direction or axis of flow of the continuous form path sheet in the print-out mechanism of a computer. As used herein "longitudinal" means in the direction of the axis of movement of the print-out form such as a paper sheet in the print-out mechanism of a computer.

In contrast to all prior computer print-out which has been structured to be read across the sheet as applied to the paper during printing, and has thus been constrained to lines of print limited in length to the limit of length of line that can be printed across the sheet in any given machine, the present invention enables printing to be read along lines applied in the longitudinal direction on the print-out form paper sheet. Accordingly, length of reading line is enabled to satisfy any extent of user preference. While the number of longitudinal lines of print will be limited in any given instance by the number of characters which the machine can print in laterally spaced relation in rows across the sheet, there is no limit within practical availability of length of paper sheets or webs or forms as to the longitudinally extending lengths of the reading lines. This is accomplished in a mechanical sense by having the characters on the print chain, print wheel, print drum, or the like, disposed with their axes respectively lying transversely instead of longitudinally as heretofore relative to the flow axis of the paper in the print-out mechanism.

Figure 1:
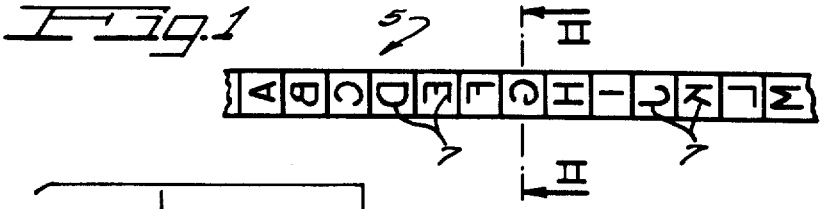
FIG. 1 is a fragmentary plan view of a type or print chain representative of the kind employed in certain computers, and modified to practice the present invention.
Figure 2:
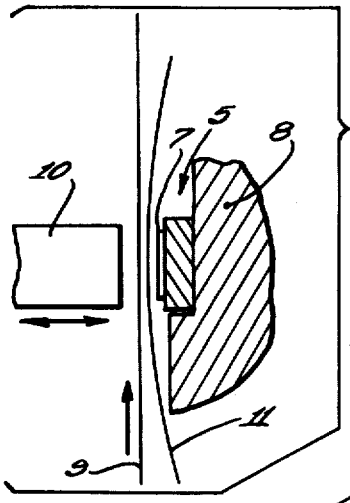
FIG. 2 is a schematic vertical sectional view taken substantially along the line II—II of FIG. 1 and illustrative of the general correlation of the print chain to the paper and printing plungers or hammers in the printer of a computer.

For example, in FIGS. 1 and 2, a fragment of a print chain 5 is shown having type characters 7 disposed with their axis longitudinally of the chain rather than transversely as is customary, so that when printed the impressions of the characters will appear in a reading format with the lines extending longitudinally rather than the prior transverse line format. Typically, during a printing or writing operation the chain 5 is driven lengthwise along a support 8 at high speed by the drive means (not shown) of the associated computer printer assembly transversely past a paper sheet 9 advancing thereby in a longitudinal flow path. Responsive to programmed electronic signals or impulses, imprinting means such as plungers or hammers 10 operate to strike toward the selected type characters 7 and drive the paper 9 theretoward so that an intervening inking device such as a ribbon 11 will produce readable impressions on the paper.

Figure 3:
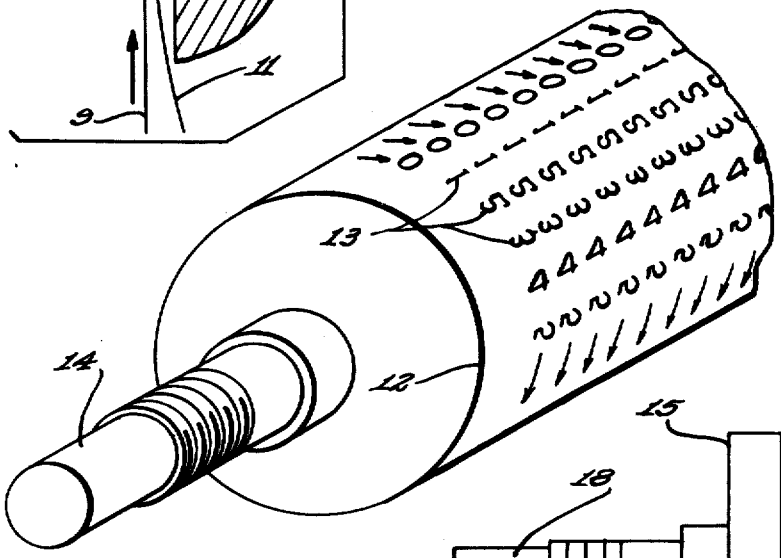
FIG. 3 is a fragmentary isometric view of a type or printing roll on the order of those used in certain other computers, and modified for practice of the present invention.
Figure 4:
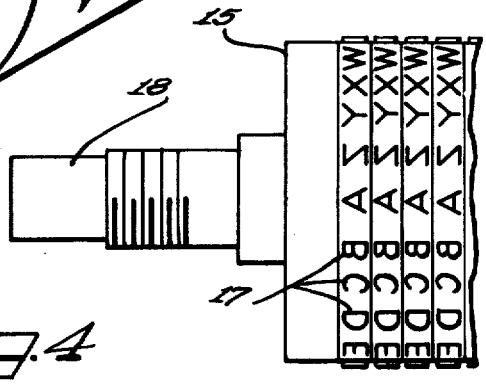
FIG. 4 is a fragmentary plan view of a print wheel assembly adapted for practice of the invention.

In FIG. 3, a representation of a print drum 12 is depicted having thereon type characters 13 each on respective axis lengthwise of the drum and in which the same character appears repeatedly in each lengthwise row on the drum but the characters are progressively different in the circumferentially spaced rows. Such a drum is caused to rotate at high speed on an axis provided by a shaft or trunnions 14 transverse to the flow of the paper in the print-out mechanism, and imprinting may be effected similarly as in respect to the chain.

In a type carrying or print wheel assembly 15, type characters 17 are located on a set of coaxial wheels. These may be mounted to rotate about the axes provided by a shaft 18 and carry the type 17 each on a respective transverse axis, according to the principles of the present invention, in similar arrangement as on the solid drum and imprinting may be similarly effected.

With any of the printing arrangements, the computer will be programmed to effect the printing in a manner to enable reading of the printed material along the longitudinal lines rather than along the transverse rows of printed characters, with the capability of having on the printed sheet as many longitudinal lines of print as there is printing capacity for the particular machine. For example, in respect to the print chain 5, the number of longitudinal print-out lines is limited by the transverse extent or length of the array of electronically actuated printing hammers 10; and in respect to the drum 12 or the print wheels 15, the length of the rows of identical characters along the length of the roll or wheel assembly limits the number of longitudinal lines of print. For example, where the transverse capacity is 144 imprinted characters, according to the present invention 144 longitudinal printed lines of material can be produced which can extend continuously indefinitely within the limitations of paper sheet length and user requirement or preferences.

Conversion of existing machines to receive the print device, whether chain or drum or wheels can be effected readily utilizing the same techniques and steps as employed heretofore in changing the printing devices for such purposes as to convert from numeric type to alphabetical type or to alpha-numeric type or for repair. Most machines are constructed to enable printing device change easily and quickly. Therefore a print chain, or print wheel or drum enabling longitudinally extended printing according to the present invention involves only a substitution of a printing device having the characters oriented for longitudinal extended printing for a device having the conventional orientation of the characters for transversely orientated printing.

Numerous advantages accrue from the present invention. Among these may be mentioned that it will enable the user to format his output data all on one page, thereby making the data easy to locate, easy to read and analyze and more concise. Because the data can be located on one page, it will eliminate the user or format designer having to redesign around the transverse limiting constraint imposed upon him by the prior computer configuration. A report constructed by use of the present invention easily lends itself to graphics presentation. Since the data is on one piece or at best only a few pieces of paper, the user can easily display the data results without having to go through the lengthy, complex process of cutting and pasting fragmented data material together. There is no need to cram important data as has been practiced where it is desired to have all important data on one reading line, since there is unlimited freedom to supply the data in a single line, thus greatly improving readability and enabling more ready picking out of important information from unimportant. Thus report readability and useability are substantially improved. Where comparative information is presented the longitudinally extended printing according to the present invention affords flexibility and potentials for presentation not available where the transverse line method is employed. Heretofore the user of a report frequently had to refer to several pages, thus discouraging proper or advantageous use of reports. In contrast the present invention enables presentation of comparative data in parallel lines, easily readable and of any desired length.

Important savings in the volume of paper employed in presenting data are effected. Heretofore the rule of thumb in the data processing industry has been that about sixty-six longitudinally spaced transverse lines of print were just about all the useable space on one page piece of paper. In the course of print-out this requires skipping to the next page which must be reheaded either by the computer printing the heading or by using preprinted forms. Therefore, according to prior practice a great deal of time is wasted by the printer before it can start printing useable data as each skip is called for. There is a proliferation in the number of page headings and the amount of unused printing time on the machine. According to the present invention paper skipping can be eliminated or at least reduced to an insignificant minimum because data which heretofore required numerous pages can be placed on a single continuous page. Significant savings in both processing and printing costs are thus effected. By having long or continuous multi-page lengths without any breaks greatly facilitates and reduces the length of microfilm to which the data may be transferred for storage.

Although adoption of the present invention may be by way of completely new user programs, it can be readily adapted with or into existing user programs. The user simply includes in the control system for the machine, such as control cards, a control card or other control device suitable for the particular machine which will control the machine in accordance with the appropriate subroutines to attain the desired results in longitudinally extended printing. For example, if the user wishes a report that has two-hundred and fifty characters in each longitudinal line and one-hundred lines transversely, the control device supplied to the machine will control it within those parameters. Where the longitudinally extended printing according to the present invention is to be integrated with the user's prior programs which have been set up according to the transverse line printing, the control device for the particular machine would include such as will allocate the required amount of magnetic core necessary for the prior program material plus the additional amount of core area necessary for the addition of new material according to the longitudinally extended printing method. Once the new data has been added to the prior program material, the same processing logic comes into play and the prior program material as well as the new material are printed out in the longitudinally extended manner of the present invention. It will thus be apparent that the present invention provides for full flexibility in user programming.

Figure 5:
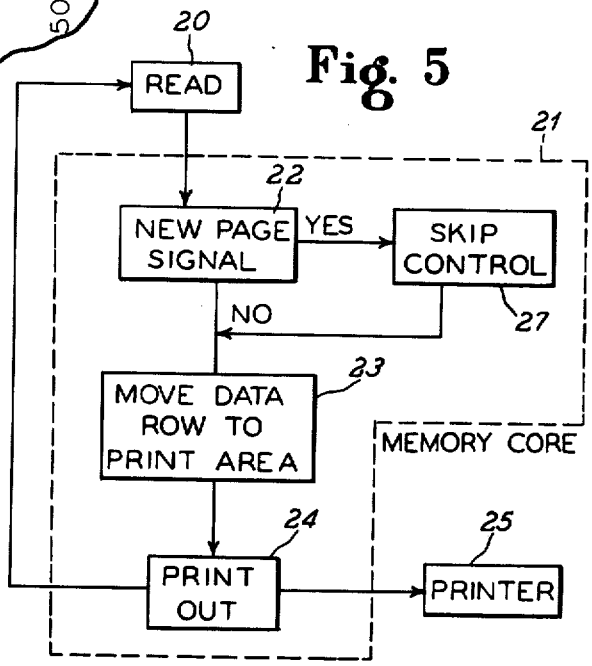
FIG. 5 is a schematic of prior art computer programming for conventional print out.

By way of contrast with programming a computer according to the present invention, as will be explained in connection with FIG. 6, there is depicted for graphic understanding of the important differences in the two types of programming, a representation in FIG. 5 of programming effected for the conventional across the page reading in computer output reports. Thus, data input reading is represented by the box 20 from which the data is transferred to a memory core 21 wherein if there is no new page signal given successive rows of data are sent to the core output print area, which step in the process is represented by the box 23. Each row of computer data is then transferred as indicated by the box 24 to the printing device 25 in which the rows of data are printed for reading across the page. If a new page signal is given, skip control represented by the box 27 is effected to skip the computer printer to the top of a new page by a channel control.

Figure 6:
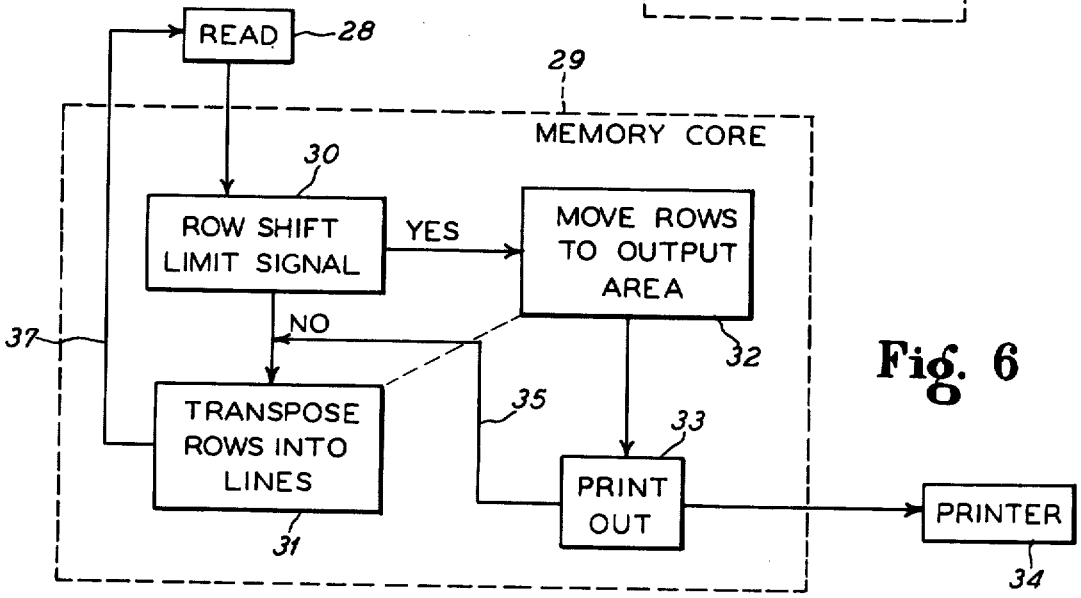
FIG. 6 is a schematic illustration of computer programming for practice of the present invention.

In contrast, according to the present invention, the computer is programmed as schematically shown in FIG. 6. The computer input is read as represented by the box 28. Input may be according to any device such as by way of tape, disc, cards, etc., or any combination thereof, the data is transferred from the input read 28 into memory core 29 where it is monitored for a row shift limit signal represented by the box 30. Where there is not such signal as each row of input data is received in the memory core, the input material is transposed as represented by the box 31 into lines of data in the save area of the core where the lines of data are stored until the desired number of lines of data for a complete report of whatever length desired has been reached, whereupon a shift signal is effected to move the rows of shifted data from the save area to the output printed area as represented by the box 32. Print out is then effected as represented by the box 33 which transfers the data to the printing device 34. Each successive transverse row of data is correspondingly transferred from the core save area at the advent when the row shift limit signal is reached (step 30) to the core print out area until all the row shift data has been transferred and printed (steps 32 and 33). After all the data has been transferred in steps 32 and 33 the program then again repeats the same process diagrammed in steps 31, 37, 28, 30 until another "row shift limit signal" is reached at which time the above is again performed. It will be noted that the read to transpose steps are cycled as represented by the line 37 between each row shift limit signal as given.

According to the present invention printing is effected by separately and selectively printing a plurality of characters in successive rows which extend across the sheet transversely to the sheet flow axis, with the rows following one another in parallel relation on the sheet, aligning the characters of each row with the characters of the other rows along a plurality of longitudinal lines parallel to the sheet flow axis, the number of lines corresponding in number to the number of characters in the transverse row, advancing the form sheet along the sheet flow axis as printing of each of the rows of characters is completed, until a predetermined number of transverse rows of characters has been printed and programming the printing of the characters to provide intelligible context in the longitudinal parallel lines of characters when read along said lines parallel to said sheet axis.

Figure 7:
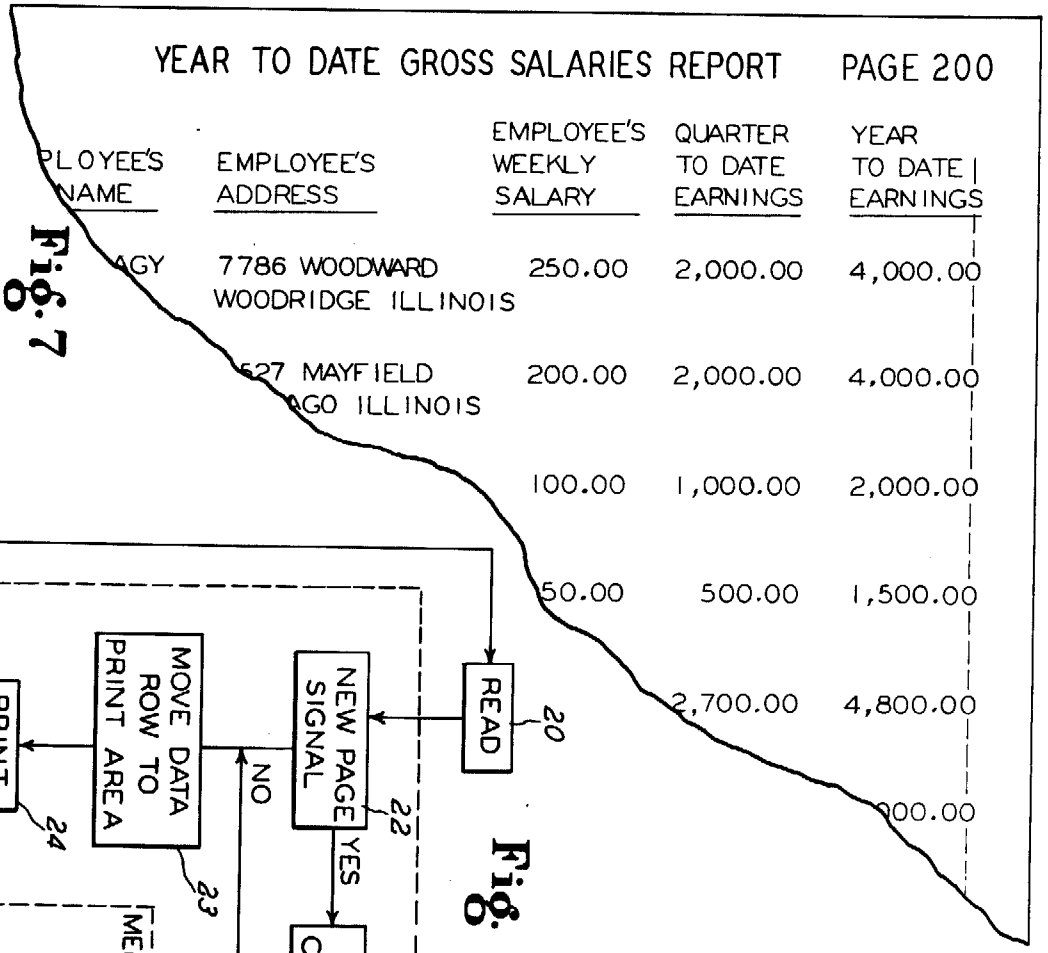
FIG. 7 is a fragmentary illustration of a representative report sheet produced according to the present invention.

By way of example of a report form attainable by practice of the present invention, reference may be had to FIG. 7. This shows how on one sheet data relating to numerous factors in the employment records of numerous employees can be collated, thus doing away with numerous pages in a report having thereon constant repetition of the same identifying data. Employee records consume vast volumes of report forms in most business and industrial concerns.

It will be understood that variations and modifications may be effected without departing from the spirit and scope of the novel concepts of this invention.

I claim as my invention:

1. In a method of output printing by means of a computer equipped with a printer capable of printing on a print-out form sheet a substantial number of character imprints in rows across the sheet as the sheet is advanced along a longitudinal flow axis in the printer with the rows as printed succeeding one another in parallel relation on the sheet and extending normal to said longitudinal flow axis, the printer being provided with imprintable printing characters which have their upright reading axes oriented normal to said longitudinal flow axis of the sheet, the character imprints of each row being aligned with the character imprints of the other rows to form longitudinal lines of character imprints which extend parallel to said longitudinal flow axis from a leading end portion of the sheet to the trailing end portion of the sheet and provide printed material to be read in a direction parallel to said longitudinal flow axis, the improvement comprising:

printing with said printing characters of said printer a selected plurality of said character imprints across the leading end portion of the sheet in a row extending normal to said longitudinal flow axis of the sheet and with the reading axes of the imprinted characters aligned across the sheet and normal to said longitudinal flow axis;

thereby completing on the sheet the character imprints for the leading extremities of said longitudinal lines of character imprints for forming the printed material to be read in a direction parallel to said longitudinal flow axis of the sheet;

progressively advancing the form sheet one imprint row at a time along said longitudinal flow axis of the sheet in the direction of the leading end portion of the sheet and of the leading extremities of said longitudinal lines of character imprints;

after each imprint row advance of the sheet, imprinting with said printing characters of said printer another row of a selected plurality of said character imprints to extend across the sheet and normal to the longitudinal flow axis of the sheet and with the imprinted characters in said another row being aligned in side-by-side relation to the character imprints of the preceding imprinted row of the character imprints, and thereby adding successive character imprints to said longitudinal lines of character imprints as required for forming said printed material;

continuing to add character imprints to said longitudinal lines of character imprints row-by-row by imprinting successive rows of selected pluralities of the character imprints as the sheet is progressively advanced row-by-row along said longitudinal flow axis, until finally trailing extremities of the longitudinal lines of character imprints are completed at said trailing portion of the sheet;

and thereby completing the printed material of all of said longitudinal lines of character imprints;

whereby after imprinting has been completed as a result of the row-by-row advance of the sheet along said longitudinal flow axis of the sheet, together with the coordinated successive imprinting of the rows of character imprints in row-by-row sequence until the longitudinal lines of character imprints have been completed into intelligible context, said longitudinal lines of character imprints provide printed matter which can be read in said direction parallel to said longitudinal flow axis of the sheet.

2. A method according to claim 1, comprising providing said printing characters on a type chain, driving the chain to run along an axis extending normal to said longitudinal flow axis of the sheet and with the reading axis of each of the characters lying parallel to the chain axis, and printing said rows of character imprints by impressing the characters selectively onto the sheet from the driven chain.

3. A method according to claim 1, comprising moving said printing characters into imprinting position relative to the print-out form sheet, on a rotary device rotating on an axis which extends normal to said longitudinal flow axis of the sheet and having the printing characters oriented with their reading axes extending parallel to the axis of the device, and effecting said imprinting of said rows of characters of the device onto the print-out form sheet.

* * * * *